US009672693B2

(12) United States Patent
Tongate et al.

(10) Patent No.: US 9,672,693 B2
(45) Date of Patent: Jun. 6, 2017

(54) ELECTRONIC GAMING DEVICE WITH SELECTABLE PAYLINES

(71) Applicant: Cadillac Jack, Inc., Duluth, GA (US)

(72) Inventors: Steven Tongate, Avondale Estates, GA (US); Brendan Mullins, Alpharetta, GA (US)

(73) Assignee: Cadillac Jack, Inc., Duluth, GA (US)

( * ) Notice: Subject to any disclaimer, the term of this patent is extended or adjusted under 35 U.S.C. 154(b) by 585 days.

(21) Appl. No.: 13/750,852

(22) Filed: Jan. 25, 2013

(65) Prior Publication Data

US 2013/0310139 A1 Nov. 21, 2013

Related U.S. Application Data

(63) Continuation of application No. 13/475,864, filed on May 18, 2012, now Pat. No. 9,514,607.

(51) Int. Cl.
*G07F 17/32* (2006.01)

(52) U.S. Cl.
CPC ..... *G07F 17/3244* (2013.01); *G07F 17/3262* (2013.01)

(58) Field of Classification Search
CPC ..... G07F 17/3244; G07F 17/3262; G07F 17/3211; A63F 13/00; A63F 13/12
USPC ..... 463/20, 28, 42
See application file for complete search history.

(56) References Cited

U.S. PATENT DOCUMENTS

| | | | | |
|---|---|---|---|---|
| 7,722,457 | B1 | 5/2010 | Marks et al. | |
| 2002/0151366 | A1 | 10/2002 | Walker et al. | |
| 2002/0198044 | A1 | 12/2002 | Walker et al. | |
| 2003/0114217 | A1 | 6/2003 | Walker et al. | |
| 2004/0259627 | A1* | 12/2004 | Walker | G07F 17/3211 463/20 |
| 2006/0084493 | A1* | 4/2006 | Pederson | G07F 17/34 463/20 |
| 2006/0148554 | A1* | 7/2006 | Hornik et al. | 463/20 |
| 2006/0211484 | A1 | 9/2006 | Hornik et al. | |
| 2007/0026923 | A1 | 2/2007 | Muir | |
| 2007/0054726 | A1* | 3/2007 | Muir et al. | 463/16 |
| 2007/0060245 | A1 | 3/2007 | Veenker | |
| 2007/0161424 | A1 | 7/2007 | Gatto et al. | |
| 2007/0167238 | A1 | 7/2007 | Gatto et al. | |
| 2007/0270208 | A1* | 11/2007 | Caspers et al. | 463/20 |
| 2008/0113735 | A1 | 5/2008 | Maya | |
| 2008/0113775 | A1 | 5/2008 | Williams et al. | |
| 2009/0093297 | A1* | 4/2009 | Seelig et al. | 463/20 |
| 2009/0215521 | A1 | 8/2009 | Borissov et al. | |
| 2009/0312095 | A1 | 12/2009 | Durham et al. | |
| 2011/0014975 | A1* | 1/2011 | Grabiec | G07F 17/34 463/25 |

* cited by examiner

*Primary Examiner* — Omkar Deodhar
*Assistant Examiner* — Shauna-Kay Hall
(74) *Attorney, Agent, or Firm* — Weide & Miller, Ltd.

(57) ABSTRACT

Examples disclosed herein relate to systems and methods, which may receive primary wagers on a first payline and a second payline. The systems and methods may receive one or more secondary wagers on one or more selected paylines. The selected paylines may be based on data received from a player. The systems and methods may determine a selected paylines payout based on the one or more selected paylines.

20 Claims, 13 Drawing Sheets

Winning Events By Payline Row

| | |
|---|---|
| ROW A | 40% |
| ROW B | 20% |
| ROW C | 10% |
| ROW D | 18% |
| ROW E | 12% |

| PAYLINE | COMPLETED |
|---|---|
| 1 | YES |
| 2 | |
| 3 | |
| 4 | YES |
| 5 | |
| 6 | |
| 7 | |

ELECTRONIC GAMING DEVICE WITH SELECTABLE PAYLINES

CROSS-REFERENCE TO RELATED PATENT APPLICATION

This application is a continuation of prior application Ser. No. 13/475,864 entitled "ELECTRONIC GAMING DEVICE WITH SELECTABLE PAYLINES", filed on May 18, 2012, which is incorporated herein by reference in its entirety.

FIELD

The subject matter disclosed herein relates to an electronic gaming device. More specifically, the disclosure relates to an electronic gaming device, which provides gaming options relating to payline structures.

INFORMATION

The gaming industry has numerous casinos located both worldwide and in the United States. A client of a casino or other gaming entity can gamble via various games of chance. For example, craps, roulette, baccarat, blackjack, and electronic games (e.g., a slot machine) where a person may gamble on an outcome.

Paylines of an electronic gaming device (e.g., a slot machine) are utilized to determine when predetermined winning symbol combinations are aligned in a predetermined pattern to form a winning combination. A winning event occurs when the player successful matches the predetermined winning symbols in one of the predetermined patterns.

BRIEF DESCRIPTION OF THE FIGURES

Non-limiting and non-exhaustive examples will be described with reference to the following figures, wherein like reference numerals refer to like parts throughout the various figures.

FIG. 5(*b*) is an illustration of an informational table displayed on an electronic gaming device, according to one embodiment.

FIG. 5(*c*) is an illustration of another information table displayed on an electronic gaming device, according to one embodiment.

FIG. 5(*d*) is an illustration of a symbol utilized with the electronic gaming device, according to one embodiment.

FIG. 5(*e*) is an illustration of the tracking of the symbol areas being covered as winning events are being achieved, according to one embodiment.

FIG. 6(*b*) is an illustration of a customized payline being developed as selected by a player, according to one embodiment.

FIG. 6(*c*) is an illustration of an alternate customized payline being developed as selected by a player, according to one embodiment.

DETAILED DESCRIPTION

Figure 1:
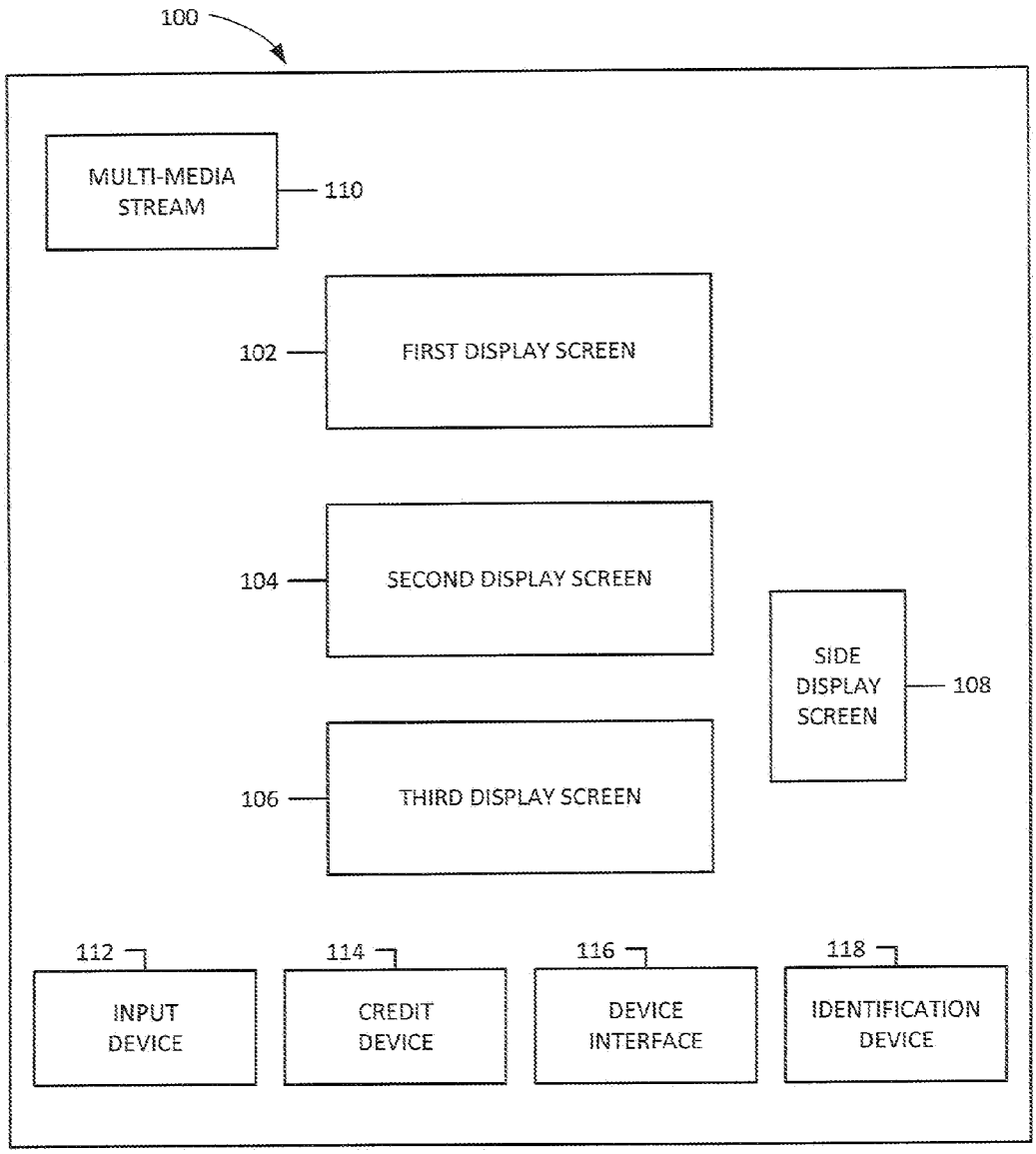
FIG. 1 is an illustration of the electronic gaming device, according to one embodiment.

FIG. 1 is an illustration of an electronic gaming device 100. Electronic gaming device 100 may include a first display screen 102, a second display screen 104, a third display screen 106, a side display screen 108, a multi-media stream 110, an input device 112, a credit device 114, a device interface 116, and an identification device 118. Electronic gaming device 100 may display game play (including bonus play), game outcomes, game branding, or other streaming and/or prerecorded media on first display screen 102. Electronic gaming device 100 may display game play (including bonus play), game outcomes, game branding, or other streaming and/or prerecorded media on second display screen 104. Electronic gaming device 100 may display game play (including bonus play), game outcomes, game branding, or other streaming and/or prerecorded media on third display screen 106. Electronic gaming device 100 may display game play (including bonus play), game outcomes, game branding, or other streaming and/or prerecorded media on side display screen 108. Electronic gaming device 100 may display game play (including bonus play), game outcomes, game branding, or other streaming and/or prerecorded media on first display screen 102 in combination with second display screen 104 and/or third display screen 106 and/or side display screen 108 and/or in any other combination of display screens. For example, a single large image could be partially displayed on second display screen 104 and partially displayed on third display screen 106, so that when both display screens are put together they complete one image.

First display screen 102 may be a liquid crystal display ("LCD"), a cathode ray tube display ("CRT"), organic light-emitting diode display ("OLED"), plasma display panel ("PDP"), electroluminescent display ("ELD"), a light-emitting diode display ("LED"), or any other display technology. First display screen 102 may be used for displaying primary games or secondary (bonus) games, advertising, player attractions, electronic gaming device 100 configuration parameters and settings, game history, accounting meters, events, alarms, or any combination thereof. Second display screen 104, third display screen 106, side display screen 108, and any other screen may utilize the same technology as first display screen 102 and/or any combination of technologies.

Electronic gaming device 100 may stream or play prerecorded multi-media 110, which media may be displayed on first display screen 102. The media may be obtained from one or more gaming content sources, a central server, another content source, and/or any combination thereof. Electronic gaming device 100 may stream or play prerecorded multi-media 110, which media may be displayed on second display screen 104. The media may be obtained from one or more gaming content sources, a central server, another content source, and/or any combination thereof. Electronic gaming device 100 may stream or play prerecorded multi-media 110, which media may be displayed on third display screen 106. The media may be obtained from one or more gaming content sources, a central server, another content source, and/or any combination thereof. Electronic gaming device 100 may stream or play prerecorded multi-media 110, which media may be displayed on side display screen 108. The media may be obtained from one or more gaming content sources, a central server, another content source, and/or any combination thereof. For example, video streams may be obtained from one or more other casino games, such as other electronic gaming devices (e.g., slot machines), roulette tables, blackjack tables, poker tables, craps tables, or sports book events. These video streams may be obtained by cameras placed on the tables, on a person, on the walls, on the ceilings, any other location that allows for video streams to be obtained, and/or any combination thereof.

These video streams may display gaming table, sporting events, promotional events (e.g., concerts, etc.), horse/dog races, and/or any combination thereof.

Video streams may be obtained for an entertainment event, a wagering event, a promotional event, a promotional offering, an advertisement, a sporting event, any other event, and/or any combination thereof. For example, the entertainment event may be a concert, a show, a live sporting event, a television program, a movie, an internet event, and/or any combination thereof. In another example, the wagering event may be a poker tournament, a horse race, a car race, and/or any combination thereof. The advertisement may be an advertisement for the casino, a restaurant, a shop, any other entity, and/or any combination thereof. The sporting event may be a football game, a baseball game, a hockey game, a basketball game, any other sporting event, and/or any combination thereof.

Input device 112 may be mechanical buttons, electronic buttons, a touch screen, or any combination thereof. Input device 112 may be utilized to make a wager, select paylines, to modify (e.g., change sound level, configuration, font, language, etc.) electronic gaming device 100, to select a movie or music, to select multi-media streams 110, to request services (e.g., drinks, manager, etc.), or any combination thereof.

Credit device 114 may be utilized to collect monies and distribute monies (e.g., cash, vouchers, etc.). Credit device 114 may interface via device interface 116 with a mobile device to electronically transmit money and/or credits. Credit device 114 may interface with a players' pre-established account to electronically transmit money and/or credit. For example, a player may have a credit card, other mag-stripe card, or other electronic fund transfer device on file with the location for which money and/or credits can be directly applied when the player is done. Credit device 114 may interface with a player's card to exchange player points.

Device interface 116 may be utilized to connect a player to electronic gaming device 100 through a mobile device, card, keypad, identification device 118, or any combination thereof. Device interface 116 may include a docking station by which a mobile device is plugged into electronic gaming machine 100. Device interface 116 may include an over the air connection by which a mobile device is connected to electronic gaming machine 100 (e.g. Bluetooth, Near Field technology, and/or Wi-Fi technology). Device interface 116 may include a connection to identification device 118.

Identification device 118 may be utilized to determine an identity of a player. Identification device 118 may utilize biometrics (e.g. thumb print, retinal scan, or other biometric). Identification device 118 may include a card entry slot for input device 112. Identification device 118 may include a keypad with an assigned pin number for verification. Identification device 118 may include multiple layers of identification for added security. For example, a player could be required to enter a player tracking card, and/or a pin number, and/or a thumb print, or any combination thereof. Based on information obtained by identification device 118, electronic gaming device 100 may be reconfigured. For example, the language, sound level, music, placement of video streams, placement of images, and the placement of gaming options utilized may be modified based on a player's preference data. For example, a player may have selected baseball under the sporting event preferences; the electronic gaming device 100 will then automatically display the current baseball game onto side display screen 108 and/or alternate display screen as set in the player's options.

Figure 2:
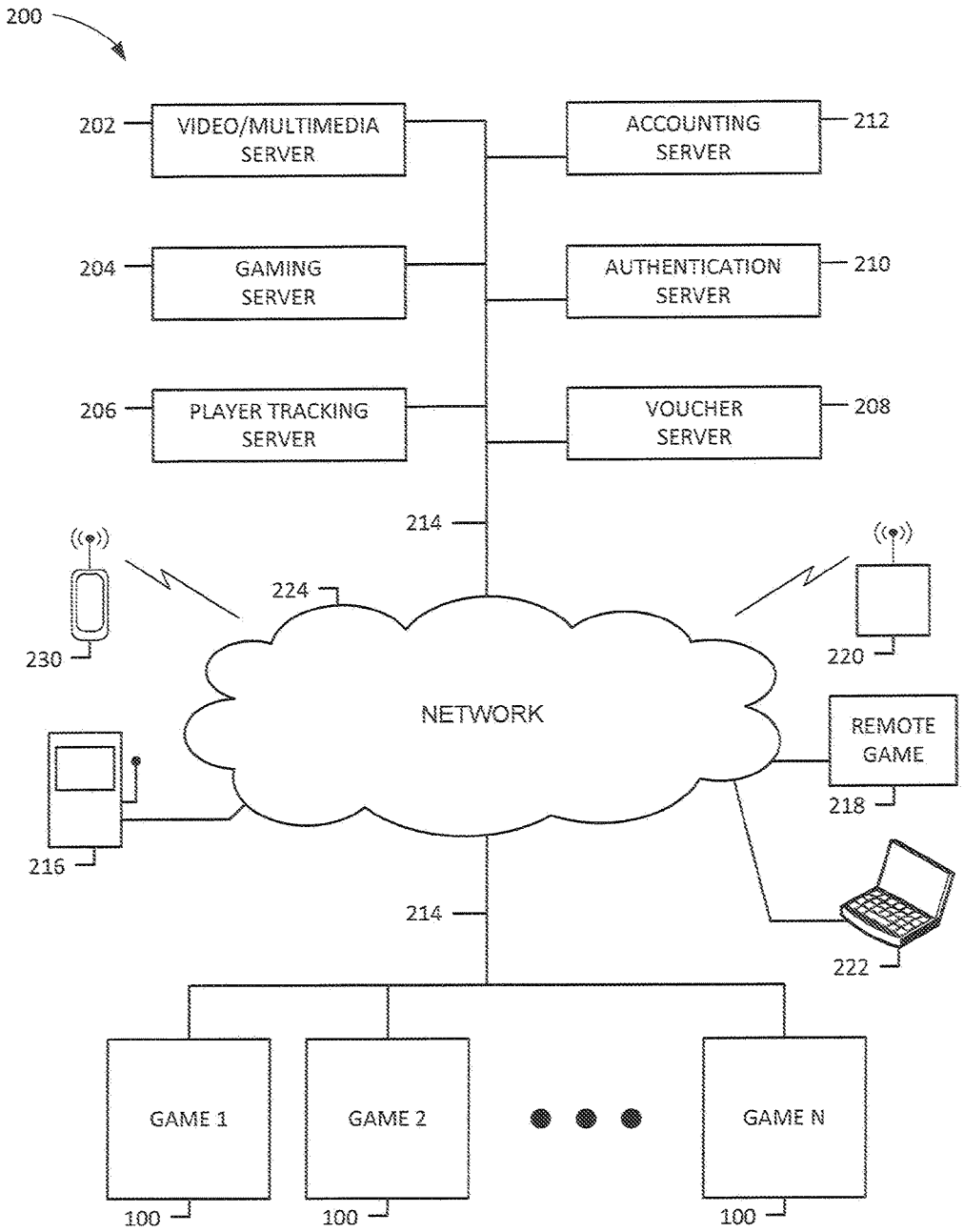
FIG. 2 is an illustration of an electronic gaming system, according to one embodiment.

In FIG. 2, an electronic gaming system 200 is shown. Electronic gaming system 200 may include a video/multimedia server 202, a gaming server 204, a player tracking server 206, a voucher server 208, an authentication server 210, and an accounting server 212.

Electronic gaming system 200 may include video/multimedia server 202, which may be coupled to network 224 via a network link 214. Network 224 may be the internet, a private network, or a network cloud. One or more video streams may be received at video/multimedia server 202 from other electronic gaming devices 100. Video/multimedia server 202 may transmit one or more of these video streams to a mobile phone 230, electronic gaming device 100, a remote electronic gaming device at a different location in the same property 216, a remote electronic gaming device at a different location 218, a laptop 222, and/or any other remote electronic device 218. Video server 202 may transmit these video streams via network link 214 and/or network 224.

For example, a remote gaming device at the same location may be a casino with multiple casino floors, a casino which allows wagering activities to take place from the room, a casino which may allow wagering activities to take place from the pool area, etc. In another example, the remote devices may be at another location, such a progressive link to another casino, or a casino corporation, which owns many different casinos (e.g. MGM, Caesars, etc.).

Gaming server 204 may generate gaming outcomes. Gaming server 204 may provide electronic gaming device 100 with game play content. Gaming server 204 may provide electronic gaming device 100 with game play math and/or outcomes.

Player tracking server 206 may track a player's betting activity, a player's preferences (e.g., language, font, sound level, drinks, etc.). Based on data obtained by player tracking server 206, a player may be eligible for gaming rewards (e.g. free play), promotions, and/or other awards (e.g., complimentary food, drinks, lodging, concerts, etc.).

Voucher server 208 may generate a voucher, which may include data relating to gaming. Further, the voucher may include payline structure option selections.

Authentication server 210 may determine the validity of vouchers, player's identity, and/or an outcome for a gaming event.

Accounting server 212 may compile, track, and/or monitor cash flows, voucher transactions, winning vouchers, losing vouchers, and/or other transaction data. Transaction data may include the number of wagers, the size of these wagers, the date and time for these wagers, the identity of the players making these wagers, and the frequency of the wagers. Accounting server 212 may generate tax information relating to these wagers. Accounting server 212 may generate profit/loss reports for player's tracked outcomes.

Network connection 214 may be used for communication between dedicated servers, thin clients, thick clients, back-office accounting systems, etc.

Laptop computer 222 and/or any other electronic device (e.g., mobile phone 230, electronic gaming device 100, etc.) may be used for downloading new gaming device applications or gaming device related firmware through remote access.

Laptop computer 222 and/or any other electronic device (e.g., mobile phone 230, electronic gaming device 100, etc.) may be used for uploading accounting information (such as cashable credits, non-cashable credits, coin in, coin out, bill in, voucher in, voucher out, etc.).

Network 224 may be a local area network, a casino premises network, a wide area network, a virtual private network, an enterprise private network, the Internet, or any combination thereof. Hardware components such as network interface cards, repeaters and hubs, bridges, switches, routers, and firewalls, or any combination thereof may also be part of the network 224.

Figure 3:
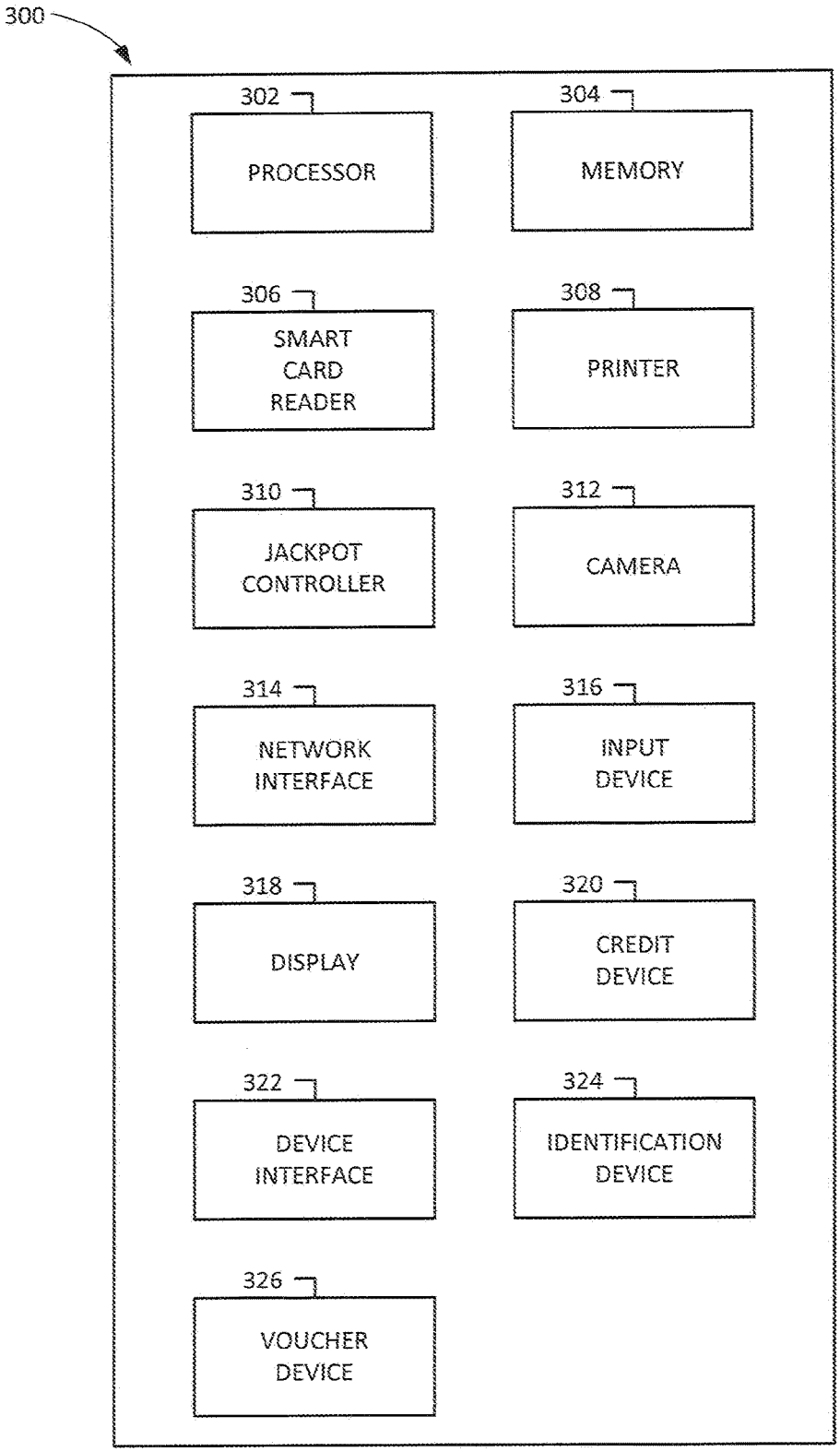
FIG. 3 is a block diagram of the electronic gaming device, according to one embodiment.

FIG. 3 shows a block diagram 300 of electronic gaming device 100. Electronic gaming device 100 may include a processor 302, a memory 304, a smart card reader 306, a printer 308, a jackpot controller 310, a camera 312, a network interface 314, an input device 316, a display 318, a credit device 320, a device interface 322, an identification device 324, and a voucher device 326.

Processor 302 may execute program instructions of memory 304 and uses memory 304 for data storage. Processor 302 may also include a numeric co-processor, or a graphics processing unit (or units) for accelerated video encoding and decoding, or any combination thereof.

Processor 302 may include communication interfaces for communicating with electronic gaming device 100, electronic gaming system 200, and user interfaces to enable communication with all gaming elements. For example, processor 302 may interface with memory 304 to access a player's mobile device through device interface 322 to display content onto display 318. Processor 302 may generate a voucher based on a wager confirmation, which may be received by an input device, a server, a mobile device, and/or any combination thereof. A voucher device may generate, print, transmit, or receive a voucher. Memory 304 may include communication interfaces for communicating with electronic gaming device 100, electronic gaming system 200, and user interfaces to enable communication with all gaming elements. For example, the information stored on memory 304 may be printed out onto a voucher by printer 308 and/or video or pictures captured by camera 312 may be saved and stored on memory 304. Memory 304 may include a confirmation module, which may authenticate a value of a voucher and/or the validity of the voucher. The processor may determine a value of the voucher based on generated voucher data and data in the confirmation module. Electronic gaming device 100 may include a player preference input device. The player preference input device may modify a game configuration. The modification may be based on data from the identification device.

Memory 304 may be non-volatile semiconductor memory such as read-only memory ("ROM"), erasable programmable read-only memory ("EPROM"), electrically erasable programmable read-only memory ("EEPROM"), flash memory ("NVRAM"), or Nano-RAM (carbon nanotube random access memory), and/or any combination thereof.

Memory 304 may also be volatile semiconductor memory such as dynamic random access memory ("DRAM") or static random access memory ("SRAM"), and/or any combination thereof.

Memory 304 may also be a data storage device such as a hard disk drive, an optical disk drive such as CD, DVD, or Blu-ray, a solid state drive, a memory stick, a CompactFlash card, a USB flash drive, a MultiMediaCard, a xD-Picture Card, or any combination thereof.

Memory 304 may be used to store read-only program instructions for execution by processor 302, for the read-write storage for global variables and static variables, read-write storage for uninitialized data, read-write storage for dynamically allocated memory, and for the read-write storage of the data structure known as the stack, or any combination thereof.

Memory 304 may be used to store the read-only pay table information for which symbol combinations on a given payline that result in a win (payout) are established for games of chance such as slot games and video poker.

Memory 304 may be used to store accounting information (such as cashable electronic promotion in, non-cashable electronic promotion out, coin in, coin out, bill in, voucher in, voucher out, electronic funds transfer in, etc.).

Memory 304 may be used to record error conditions on an electronic gaming device 100 such as door open; coin jam; ticket print failure; ticket (paper) jam; program error; reel tilt; etc. or any combination thereof.

Memory 304 may also be used to record the complete history for the most recent game played plus some number of prior games as determined by the regulating authority.

Smart card reader 306 may allow electronic gaming device 100 to access and read information provided by player or technician, which may be used for setting of player preferences and/or providing maintenance information. For example, smart card reader 306 may provide an interface between a smart card (inserted by the player) and identification device 324 to verify the identity of a player.

Electronic gaming device 100 may include a printer 308 for printing vouchers, informational materials, advertisements, and/or coupons. Printer 308 may be used for printing slot machine payout receipts, slot machine wagering vouchers, non-gaming coupons, slot machine coupon (i.e., a wagering instrument with a fixed waging value that can only be used for non-cashable credits), drink tokens, comps, and/or any combination thereof.

Electronic gaming device 100 may include a jackpot controller 310, which may allow electronic gaming device 100 to interface with other electronic gaming devices either directly or through electronic gaming system 200 to accumulate a shared jackpot.

Camera 312 may allow electronic gaming device 100 to take images of player or a player's surroundings. For example, when a player sits down at the machine their picture may be taken to include their image into the game play. A picture of a player may be an actual image as taken by camera 312. A picture of a player may be a computerized caricature of image taken by camera 312. The image obtained by camera 312 may be used in connection with identification device 324 using facial recognition. Camera 312 may allow electronic gaming device 100 to record video. The video may be stored on memory 304 or stored remotely via electronic gaming system 200. Video obtained by camera 312 may then be used as part of game play, or may be used for security purposes. For example, a camera located on electronic gaming device 100 may capture video of a potential illegal activity (e.g. tampering with the machine, crime in the vicinity, underage players, etc.).

Network interface 314 may allow electronic gaming device 100 to communicate with video server 202, gaming server 204, player tracking server 206, voucher server 208, authentication server 210, and/or accounting server 212.

Input device 316 may be mechanical buttons, electronic buttons, a touch screen, or any combination thereof. Input device 316 may be utilized to make a wager, to make an offer to buy or sell a voucher, to determine a voucher's worth, to cash in a voucher, to modify electronic gaming device 100 (e.g., change sound level, configuration, font, language, etc.), to select a movie or music, to select live video streams (e.g. sporting event 1, sporting event 2, sporting event 3), to request services (e.g., drinks, manager, etc.), or any combination thereof.

Display 318 may show video streams from one or more content sources. Display 318 may encompass first display screen 102, second display screen 104, third display screen 106, side display screen 108, and/or another screen used for displaying video content.

Credit device 320 may be utilized to collect monies and distribute monies (e.g., cash, vouchers, etc.). Credit device 320 may interface with processor to allow for game play to take place. Processor may determine any payouts, display configurations, animation, and/or any other functions associated with game play. Credit device may interface with display 318 to display the amount of available credits for the player to use for wagering purposes. Credit device 320 may interface via device interface 322 with a mobile device to electronically transmit money and/or credits. Credit device 320 may interface with a player's pre-established account, which may be stored on electronic gaming system 200, to electronically transmit money and/or credit. For example, a player may have a credit card or other mag-stripe card on file with the location for which money and/or credits can be directly applied when the player is done. Credit device 320 may interface with a player's card to exchange player points.

Electronic gaming device 100 may include a device interface 322 that a user may employ with their mobile device (e.g. smart phone) to receive information from and/or transmit information to electronic gaming device 100 (e.g., watch a movie, listen to music, obtain verbal betting options, verification of identification, transmit credits, etc.).

Identification device 324 may be utilized to allow electronic gaming device 100 to determine an identity of a player. Based on information obtained by identification device 324, electronic gaming device 100 may be reconfigured. For example, the language, sound level, music, placement of video streams, placement of images, placement of gaming options, and the tables utilized may be modified based on player preference data.

For example, a player may have selected a specific baseball team (e.g., Atlanta Braves) under the sporting event preferences, the electronic gaming device 100 will then automatically (or via player input) display the current baseball game (e.g., Atlanta Braves vs. Philadelphia Phillies) onto side display screen 108 and/or alternate display screen as set in the player's options.

A voucher device 326 may generate, print, transmit, or receive a voucher. The voucher may represent a wagering option, a wagering structure, a wagering timeline, a value of wager, a payout potential, a payout, or any other wagering data. A voucher may represent an award, which may be used for other locations inside of the gaming establishment. For example, the voucher may be a coupon for the local buffet or a concert ticket.

Figure 4:
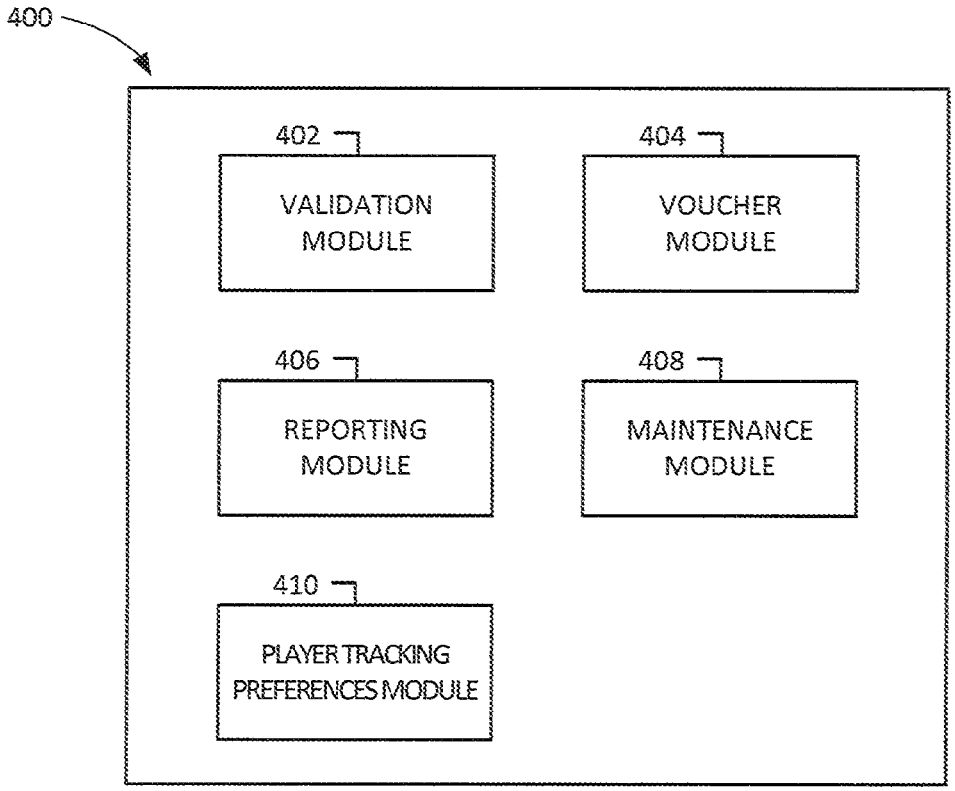
FIG. 4 is another block diagram of the electronic gaming device, according to one embodiment.

FIG. 4 shows a block diagram of memory 304, which includes various modules. Memory 304 may include a validation module 402, a voucher module 404, a reporting module 406, a maintenance module 408, and/or a player tracking preferences module 410.

Validation module 402 may utilize data received from voucher device 326 to confirm the validity of the voucher.

Voucher module 404 may store data relating to generated vouchers, redeemed vouchers, bought vouchers, and/or sold vouchers.

Reporting module 406 may generate reports related to a performance of electronic gaming device 100, electronic gaming system 200, video streams, gaming objects, credit device 114, and/or identification device 118.

Maintenance module 408 may track any maintenance that is implemented on electronic gaming device 100 and/or electronic gaming system 200. Maintenance module 408 may schedule preventative maintenance and/or request a service call based on a device error.

Player tracking preferences module 410 may compile and track data associated with a player's preferences.

Figure 5A:
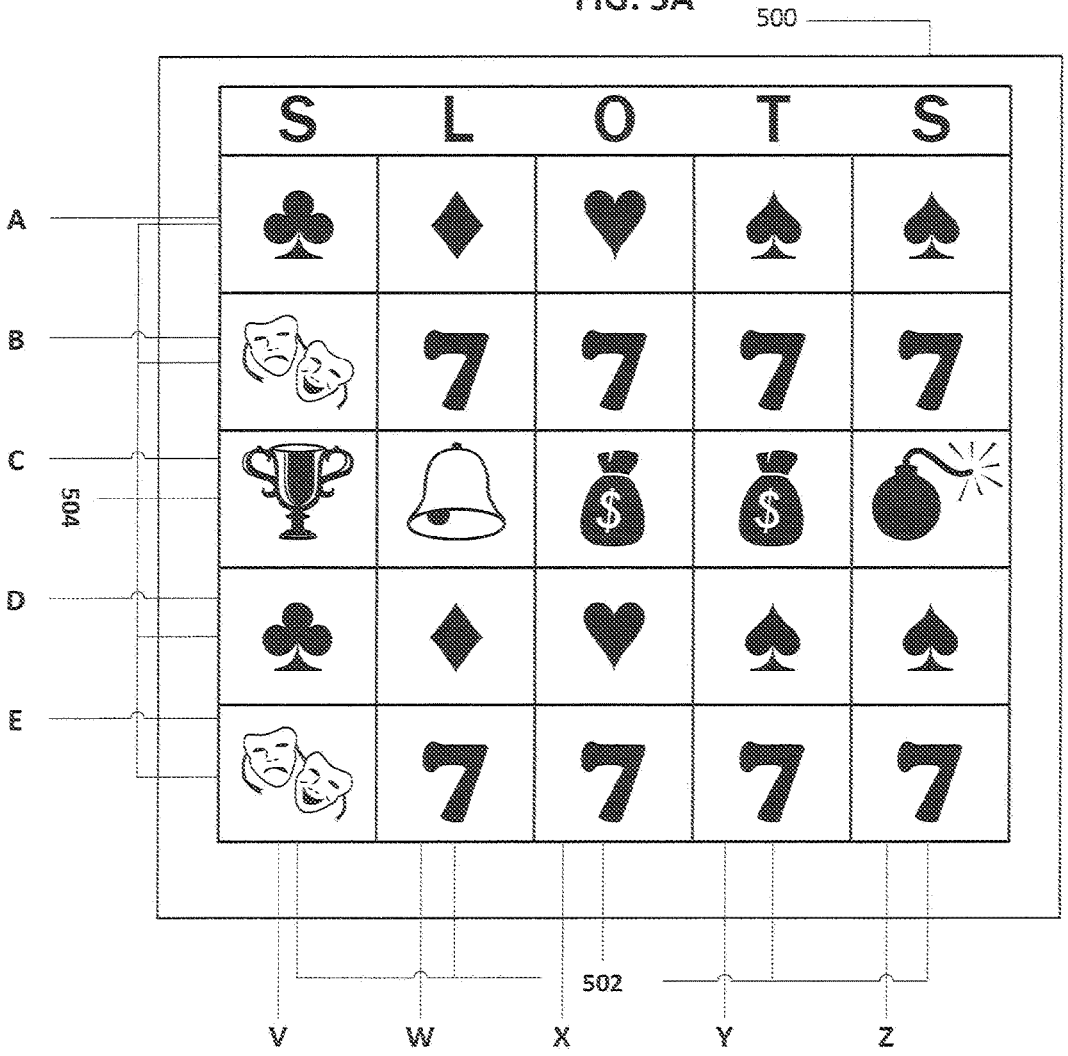
FIG. 5(*a*) is an illustration of paylines of the electronic gaming device according to one embodiment.

FIG. 5(A) shows a screen image 500 for an electronic gaming device 100 on display 318. Screen image 500 may include a predetermined number of columns 502 and a predetermined number of rows 504. Screen image 500 may include any number of rows 504 and any number of columns 502. For example, screen image 500 may have five rows 504 and ten columns 502; screen image 500 may have eight rows 504 and thirteen columns 502, or any other combinations of rows 504 and columns 502. The player may initiate a wagering event through input device 316. Images in each cell (e.g. AV, CW, DY, etc.) may scroll up and/or down and/or side-to-side. Positioning of the images displayed in the reels on screen image 500 may display the outcome of a wagering event (e.g. a win or a loss for the player).

For example, it may be that if all columns in Row A (e.g. V, W, X, Y, and Z) have the same image (e.g. cherries, bars, pictures of the player as captured by camera 312, etc.) then a winning event has occurred. Lining up of the images may happen in one of many ways. For example, if all images in the cells (e.g., AU, AV, etc.), which are touching by a shared side (e.g. AV and AW) or by a corner (e.g. AV and BW), have the same image this may represent that a winning event has occurred.

Figures 5B, 5C:
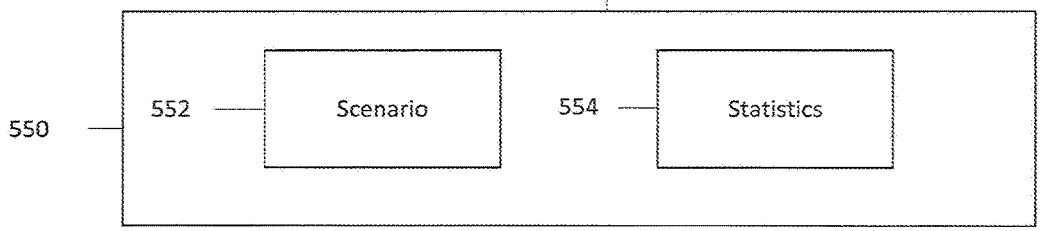

FIG. 5(B) shows an illustration of a screen image 550. Screen image 550 may include a scenario 552 and a statistics summary 554. Scenario 552 may be performance related history, which may include statistics summary 554. Scenario 552 may be wagering event outcome histories, which may include statistics summary 554. For example, FIG. 5(C) shows an illustration of screen image 550, which may display the last fifty winning events representing scenario 552, which may include statistics summary 554 of Row A comprised 40%, Row B comprised 20%, Row C comprising 10%, Row D comprising 18%, and Row E comprising 12%.

This represents that Row A has been a winner 40 percent of the time during the last fifty winning events.

In another example, the representative information may show that Row A has been a winner 40 percent of the time, Row B has been a winner 20 percent of the time, Row C has been a winner 5 percent of the time, Row D has not been a winner, Row E has been a winner 25 percent of the time, and there has been no winner 10 percent of the time.

Screen image 550 may display scenario 552, which may be the size of the wagers that the players have played with statistic summary 554, which may include what percentage of time it was played. For example, screen image 550 may show that 30% of players have played max bet (either points or money), 10% of players have wagered minimum bet, etc. Screen image 550 may display scenario 552, which may be what size jackpot was received for the statistic summary 554 of historic winning events.

For example, it may show that the last number (e.g., 5, 10, 15, or etc.) of jackpots paid by the machine were a certain amount (e.g., $1,000, $10,000, $1,000,000, etc.). Screen image 550 may display scenario 552 of how long the last number of players (e.g., 1, 5, 10, 15, or some other number) played on electronic gaming device 100. Screen image 550 may display this information for electronic gaming device 100 or for any number of electronic gaming devices, which may be connected by electronic gaming system 200.

Based on information displayed on screen image 550, a player may place a wager or bet on the reoccurrence of a scenario 552 (e.g., payline one is a winner, payline two is a winner, etc.) to repeat one or more times. Further, the player may place a wager on a reoccurrence not based on the displayed information. Based on information displayed on screen image 550, a player may place a wager or bet on the reoccurrence of more than one scenario 552 to repeat one or more times (payline one and payline two are winners, payline one and payline ten are winners, payline one will win the next two spins, payline one will win the next three spins, payline one will win during spin two and spin five, etc.). The expectation of the repeating of scenario 552 may be randomly predetermined at the time the wager is made. The expectation of the repeating of scenario 552 may be over a fixed predetermined period. The expectation of the repeating of scenario 552 may be over a number of plays (e.g. 5 plays, 10 plays, etc.). The expectation of the repeating of scenario 552 may be over an amount of time (e.g. 5 minutes, 10 minutes, etc.). The expectation of the repeating of scenario 552 may be over any trackable events or combination thereof.

The reoccurrence of scenario 552 in the determined period may pay the player an award. The reoccurrence of scenario 552 in the determined period may provide the player with a multiplier award for that event happening more than one time in the determined period (e.g., 5 minutes, 10 minutes, an hour, during the player's continues session, during the player's session for a day, a week, etc.). The multiplier may be increased to reward a reoccurrence of an outcome. For example, the player may bet that payline 2 will win during the next spin. If payline 2 is a winner during the next spin, then the player obtains a 1× multiplier. If the player continues to bet on payline 2, then the next time payline 2 is a winner the multiplier may be 3×. If the player continues to bet on payline 2, the multiplier may be increased (e.g., 5×, 6×, etc.) every time payline 2 is a winner.

In another example, if the player bets that payline 1 will win in the next 10 spins and payline 1 wins three times in the next 10 spins the player may receive 1 times the payback on the first occurrence, 4 times the payback on the second occurrence, and 10 times the payback on the third occurrence. Any combination of reoccurrence and multiplier is within the scope of this disclosure.

The player placing a wager on more than one scenario 552 may increase the award. The player placing a wager on more than one scenario 552 may increase the multiplier. For example, if the player selects that payline 1 will win and the winning symbols will be cherries, the odds of both of these occurring is lower than either one happening. In this case, the player may qualify for a 10× multiplier vs. only the 3× multiplier that may be available for each event occurring independently.

In another example, if the player selects that payline 1 will win, and payline 2 will win, the odds of both of these occurring are lower than either one on its own. In this case, the player may qualify for a higher award than may otherwise have been available.

The player placing a wager on more than one scenario 552 may decrease the award. The player placing a wager on more than one scenario 552 may decrease the multiplier. For example, if the player selects that payline 1 or payline 2 will win, the odds of either of these outcomes occurring is higher than either one happening independently. In this case, the player may qualify for a 2× multiplier vs. the 3× multiplier that may be available for each event occurring independently.

Figures 5D, 5E:
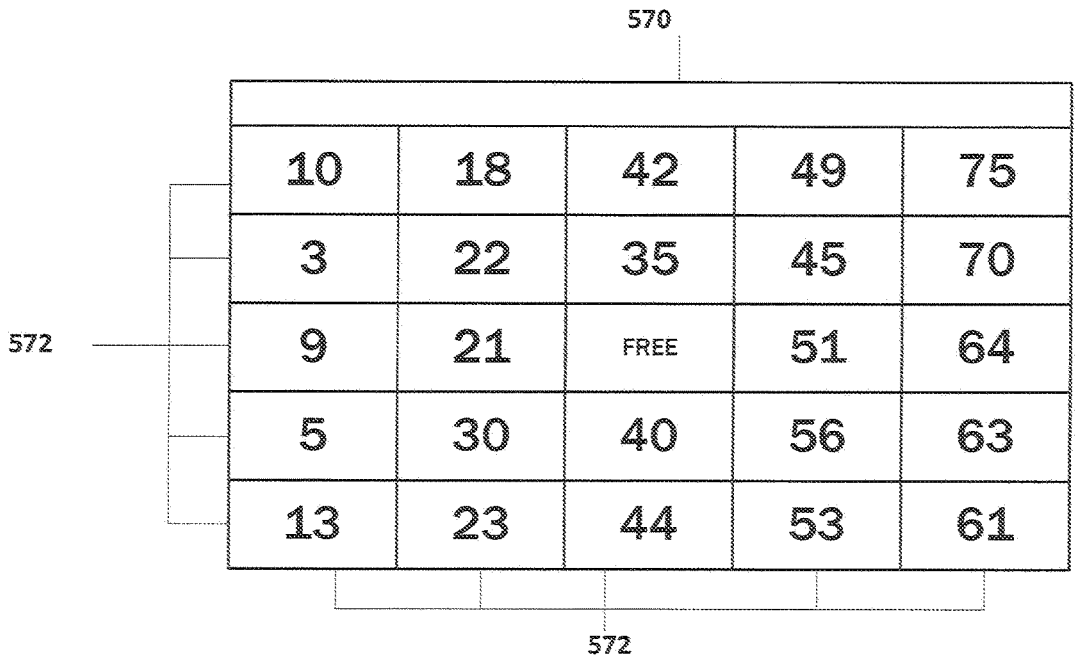

FIG. 5(D) is an image 570 from electronic gaming device 100 displayed on display 318. Image 570 may contain a predetermined number of symbols 572. Symbols 572 may represent a value. Symbols 572 may represent a game task. Symbols 572 may represent a level of wager. Symbols 572 may represent a time period. Symbols 572 may represent any requirement for the player or combination of requirements. The player may cover symbol 572 by completing the predetermined activity or task. For example, the player may cover symbol 572 by completing required winning events, by wagering a certain amount, which may include an additional side bet, by playing electronic gaming device 100 for a set amount of time, or by completing any other required activity or combination thereof.

In another example, the player may cover the symbol, which represents 10 when the player makes a size bet on payline 1 being a winner on the next spin and payline 1 as a winning payline on the next spin. If the player obtains a predetermined pattern on the board, then the player may achieve an award.

Screen image 570 may include a grid of rows and columns where the boxes created by the grid may be symbol 572. Screen image 570 may include any image or combination of images with symbols 572 to be covered. For example, image 570 may be a fruit tree where the fruit is symbol 572 to be filled in. In another example, image 570 may be a house where the windows are symbol 572 to be covered.

A player may then complete each predetermined activity, which may be shown on image 570 by filling in, covering up, crossing-out, or using some method to indicate that the particular symbol 572 task has been completed. The player may then win some additional award when all symbols 572 are covered, or when symbols 572 are covered in any pattern. For example, when a blackout is obtained (e.g., all symbols covered), or all available symbols 572 may be covered or for a game of Bingo, all available symbols 572 may be covered in a particular row and/or column. The player award may include free play on electronic gaming device 100, entering into a bonus round, a voucher, a jackpot, a payout, another item of value, and/or any combination of awards.

For example, FIG. 5(E) shows a game structure where all of the paylines may be filled in to obtain an award. To fill in the paylines, a player may wager that a payline (e.g., payline 1) or a group of paylines (e.g., payline 1 and payline 2) will be a winning payline. In an example, if a player bets on payline 1 to be a winning payline and payline 1 is a winning payline, then the player has one out of the seven paylines covered. In order to win the prize, the player may need to cover paylines 2-7. In other examples, the player may only need to cover one more payline, two more paylines, etc.

In the previous example, the player may then place a wager that paylines 2-3 will be winning paylines on the next spin. If payline 2 is a winning payline, then the player will have covered payline 2. Therefore, the player still needs to cover paylines 3-7 to win the prize. If both paylines 2-3 would have been winning paylines, then the player would have covered both paylines and only needed to cover paylines 4-7 to win the prize. The award may be adjusted (higher or lower) depending on the number of paylines the player wagered on in a single turn or period of time. For example, if the player were to wager that in the next five turns payline 1-7 would be a winning payline, the award will be decreased to adjust for the higher probability of any one of the seven paylines being a winning payline. This is opposed to if the player had only placed a wager that payline 3 would be a winning payline.

Indication that the payline is covered may be done with a replication of the winning symbols, which occurred to cover the payline. Indication that the payline is covered may be done with a table indicating which paylines are completed. Indication that the payline is covered may be done by showing a payline in a different color and/or shading. Indication that the payline is covered may be done in any way that allows a player to differentiate the covered lines from the uncovered lines.

Figure 6A:
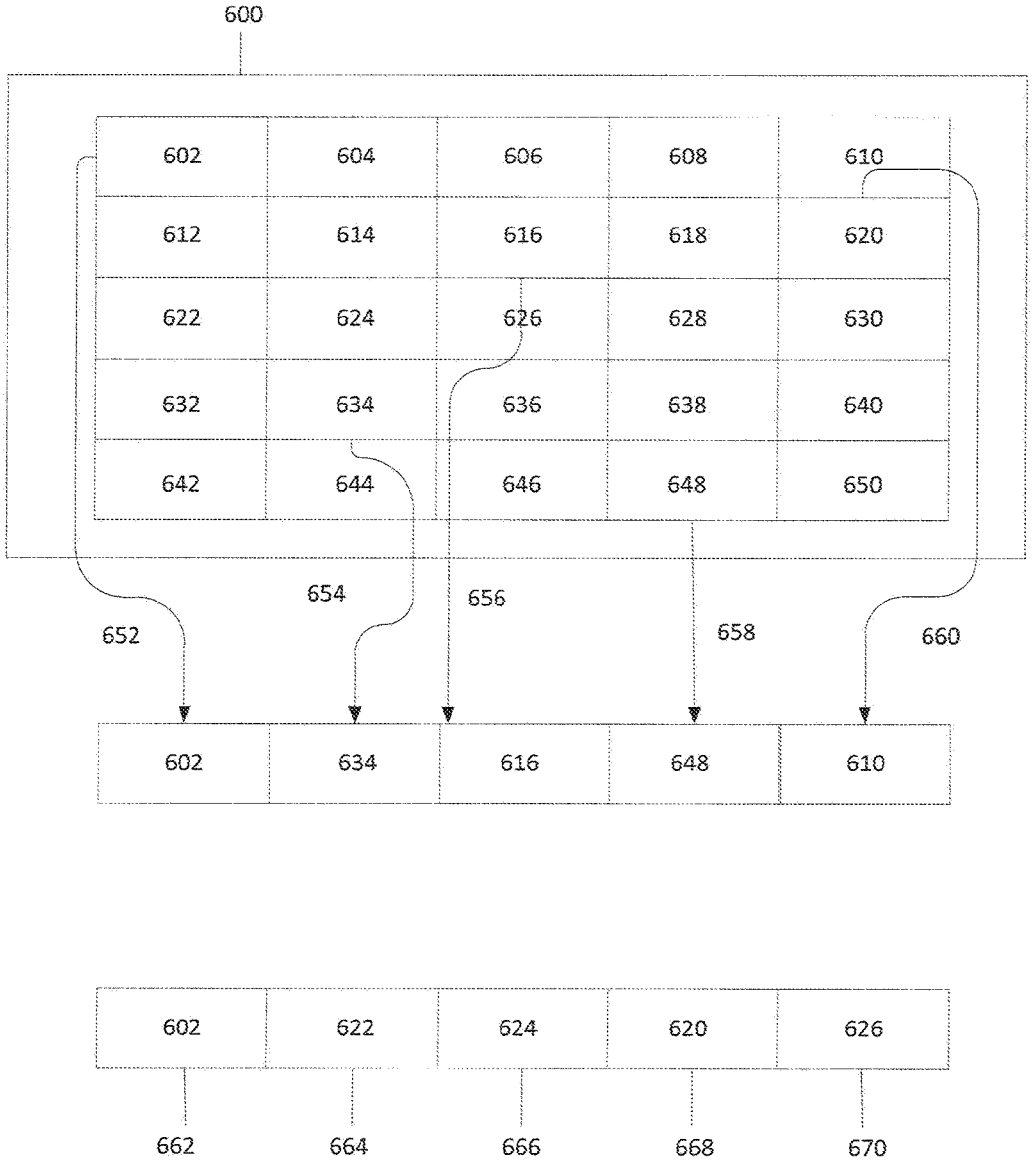
FIG. 6(*a*) is an illustration of paylines with the symbol spaces of the electronic gaming device, according to one embodiment.

FIG. 6(A) is an illustration of a screen image 600 from electronic gaming device 100 on display 318. Screen image 600 may include a first symbol space 602, a second symbol space 604, a third symbol space 606, a fourth symbol space 608, a fifth symbol space 610, a sixth symbol space 612, a seventh symbol space 614, an eighth symbol space 616, a ninth symbol space 618, a tenth symbol space 620, an eleventh symbol space 622, a twelve symbol space 624, a thirteenth symbol space 626, a fourteenth symbol space 628, a fifteenth symbol space 630, a sixteenth symbol space 632, a seventeenth symbol space 634, an eighteenth symbol space 636, a nineteenth symbol space 638, a twentieth symbol space 640, a twenty-first symbol space 642, a twenty-second symbol space 644, a twenty-third symbol space 646, a twenty-fourth symbol space 648, and a twenty-fifth symbol space 650. Screen image 600 may represent screen image 500, screen image 550, screen image 570, or any combination thereof. Screen image 600 may represent any screen image on display 318. Screen image 600 may include a predetermined number of columns and a predetermined number of rows. Screen image 600 may include any number of rows and any number of columns. For example, screen image 600 may have 5 rows and 10 columns; screen image 600 may have 8 rows and 13 columns, or any other combinations of rows and columns.

Any of the symbols may be an image of a card, a symbol, and/or other objects. For example, it could be a pot of gold, an ace of spades, a diamond, or any other symbol. The symbols may be animation. The symbols may be a picture. For example, it may be a picture of the player as taken by camera 312. The symbols may be a number. The symbols may be any image. The symbols may be blank.

Screen image 600 may represent a winning event based on a predetermined pattern of symbols. Screen image 600 may represent a winning event based on the same image being displayed in an entire row (e.g. first symbol space 602, second symbol space 604, third symbol space 606, fourth symbol space 608, and fifth symbol space 610). Screen image 600 may represent a winning event based on the same image being displayed in an entire column (e.g. first symbol space 602, sixth symbol space 612, eleventh symbol space 622, sixteenth symbol space 632, and twenty-first symbol space 642). Screen image 600 may represent a winning event based on the same image being displayed in any predetermined number of symbol spaces selected by the player.

For example, FIG. 6(B) represents one embodiment where electronic gaming device 100 may allow for, or the player may elect to wager on, five matching symbols to win. The player may select one symbol space from each column, for a total of five symbol spaces to create their own payline (e.g. line 652 may represent the selection of first symbol space 602, line 654 may represent the selection of second symbol space 634, line 656 may represent the selection of seventh symbol space 616, line 658 may represent the selection of twenty-fifth symbol space 648, and line 660 may represent the selection of nineteenth symbol space 610). The player may select any symbol space in any row and/or column. The player may select one or more symbol spaces from any row and/or column.

For example, FIG. 6(C) represents another embodiment where electronic gaming device 100 may allow for, or the player may elect to wager on, five matching symbols to win. The player may select none, one, or more symbol spaces from each column, for a total of five symbol spaces to create their own payline (e.g. reference 662 may represent the selection of first symbol space 602, reference 664 may represent the selection of eleventh symbol space 622, reference 666 may represent the selection of twelfth symbol space 624, reference 668 may represent the selection of tenth symbol space 620, and reference 670 may represent the selection of thirteenth symbol space 626.).

Symbol spaces selected by the player may share a side. Symbol spaces selected by the player may connect at a corner. Symbol spaces selected by the player may be in the same row. Symbol spaces selected by the player may be in the same column. Symbol spaces selected by the player may not share a side. Symbol spaces selected by the player may not connect at a corner. Symbol spaces selected by the player may not be in the same row. Symbol spaces selected by the player may not be in the same column. Symbol spaces selected by the player may be selected one at a time. Symbol spaces selected by a player may be selected based on an entire row. Symbol spaces selected by a player may be selected based on an entire column. Symbol spaces selected by the player may be selected based on a predetermined pattern. A player may make an additional wager for the ability to select their own symbol spaces. The ability of the player to select their own symbol spaces may be provided as an award. The ability of players to select their own symbol spaces may be in the base game. The ability of the player to select their own symbol spaces may be part of a bonus game. The player may select their own symbol spaces through input device 112.

A player may select what image they want to have indicate a winning event. A player may select an image from a predetermined list, use camera 312 to add their own image, select an image from network 200, or select an image from a mobile device connected via device interface 116.

Electronic gaming machine 100 may increase the award for selection of additional symbol spaces. Electronic gaming machine 100 may decrease the award for selection of fewer symbol spaces. For example, the player may select one symbol space to win one credit or they may select 10 spaces to win 100 credits.

Figure 7:
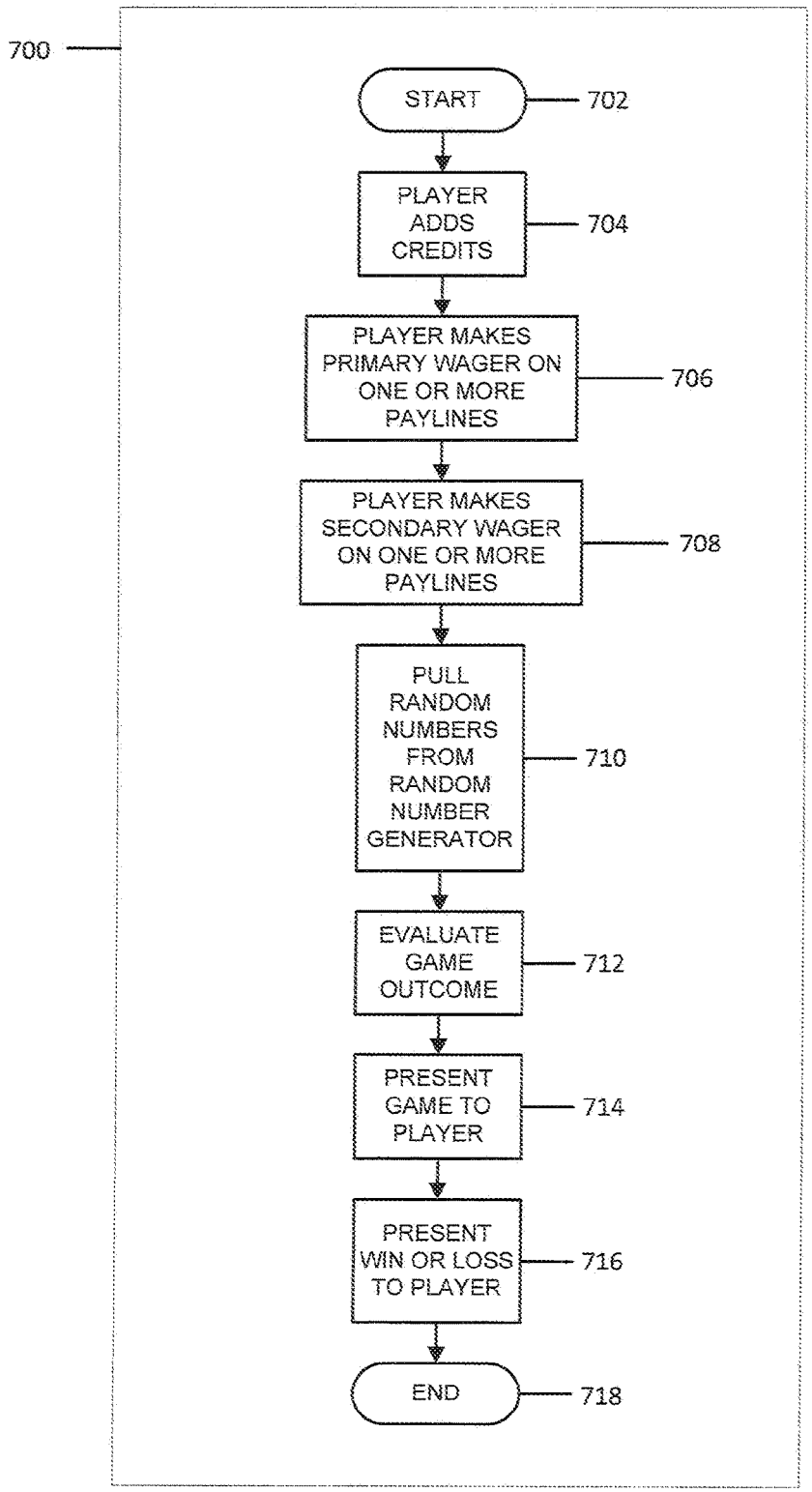
FIG. 7 is a flow diagram for accepting a primary wager and a secondary wager, according to one embodiment.

In FIG. 7, a primary and secondary wagering flow diagram 700 is shown. The method may include a starting of the game (step 702). The method may include the player adding credits to electronic gaming device 100 (step 704). The method may include the player making a primary wager on one or more paylines (step 706). The method may further include the player making a secondary wager on one or more paylines (step 708). The method may include electronic gaming device 100 pulling random numbers from the random number generator (step 710). The method may include the evaluation of the game outcome for the primary wager (step 712). The method may further include the evaluation of the game outcome for the secondary wager (step 712). The method may include presenting the game play to the player (step 714). The method may include presenting the game outcome (win or loss) to the player (step 716). The method may then end (step 718).

Figure 8:
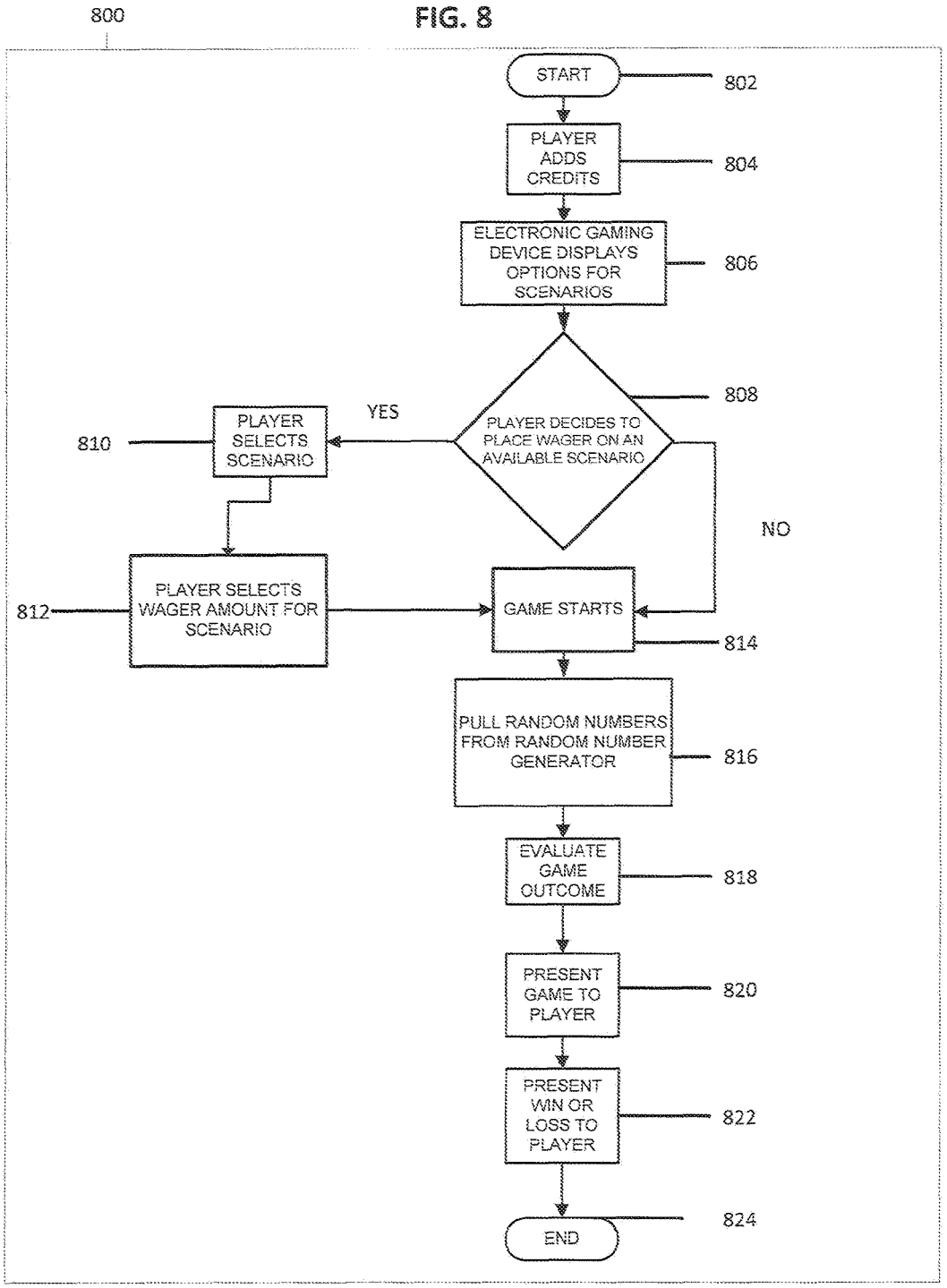
FIG. 8 is a flow diagram for allowing a player to make a wager on one or more historic scenarios, according to one embodiment.

In FIG. 8, a historic scenario wagering flow diagram 800 is shown. The method may include the starting of the game (step 802). The method may include the player adding credits to electronic gaming device 100 (step 804). The method may further display scenario options for the player to place wagers (step 806). The method may determine if a scenario wager is placed (step 808). If the scenario wager is not placed the method may move to step 814. If the scenario wager is placed, the method may move to step 810. The method may include the player selecting which scenario a wager is placed on (step 810). The method may further include the player selecting how large of a wager to place on the scenario (step 812). The method may then move to starting of the game (step 814). The method may include electronic gaming device 100 pulling random numbers from the random number generator (step 816). The method may further include the evaluation of the game outcome for the game (step 818). The method may further include the evaluation of the game outcome for the scenario wager (step 818). The method may include presenting the game play to the player (step 820). The method may include presenting the game outcome (win or loss) to the player (step 822). The method may then end (step 824).

Figure 9:
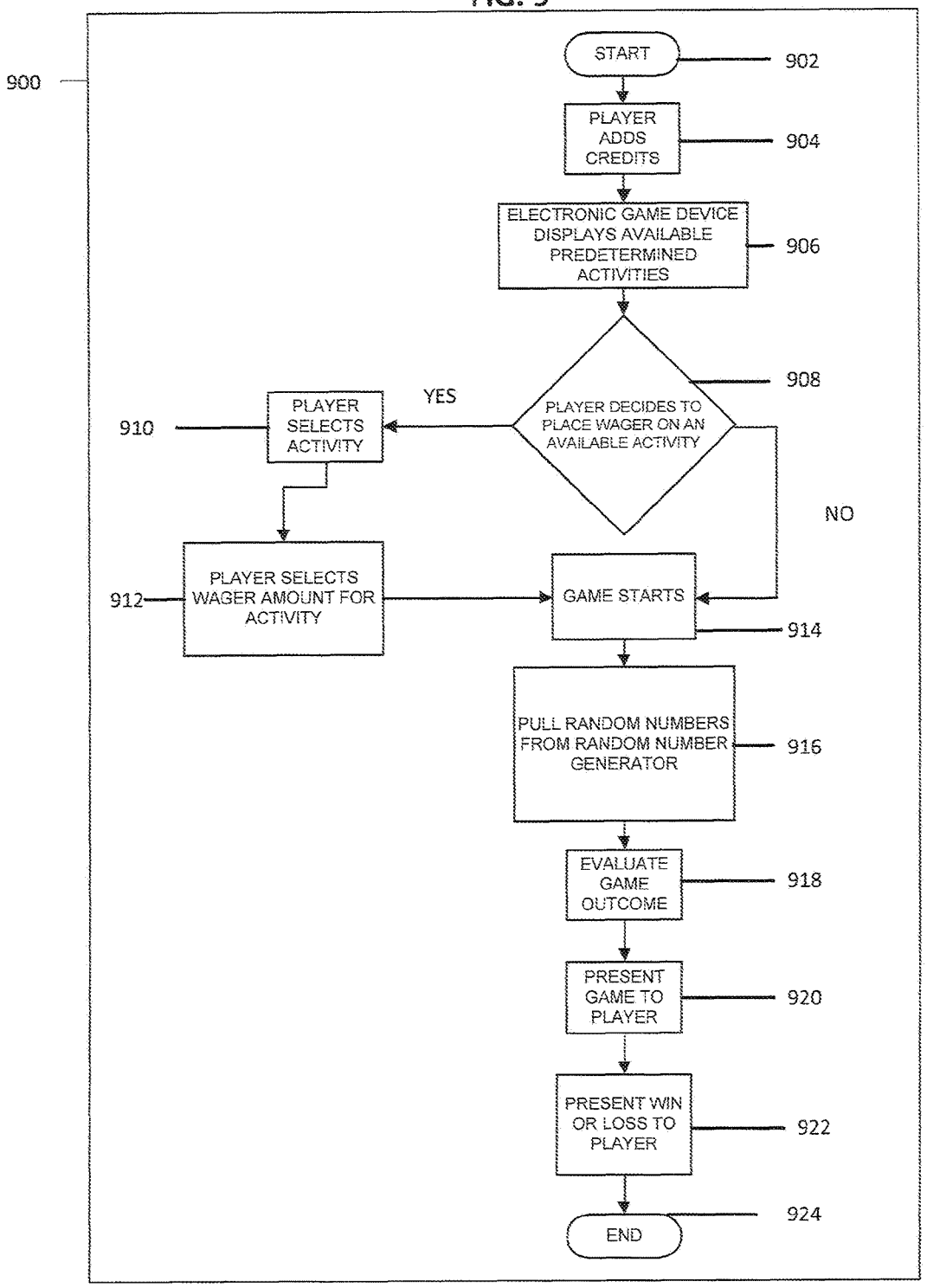
FIG. 9 is a flow diagram for allowing a player to make a wager on one or more predetermined activity, according to one embodiment.

In FIG. 9, a predetermined activity wagering flow diagram 900 is shown. The method may include the starting of the game (step 902). The method may include the player adding credits to electronic gaming device 100 (step 904). The method may further display predetermined activities onto which the player may place wagers (step 906). The method may determine if predetermined activity wager is placed (step 908). If the predetermined activity wager is not placed, the method may move to step 914. If the predetermined activity wager is placed, the method may move to step 910. The method may include the player selecting onto which predetermined activity a wager is placed (step 910). The method may further include the player selecting how large of a wager to place on the predetermined activity (step 912). The method may then move to the starting of the game (step 914). The method may include electronic gaming device 100 pulling random numbers from the random number generator (step 916). The method may further include the evaluation of the game outcome for the game (step 918). The method may further include the evaluation of the game outcome for the predetermined activity wager (step 918). The method may include presenting the game play to the player (step 920). The method may include presenting the game outcome (win or loss) to the player (step 922). The method may then end (step 924).

Figure 10:
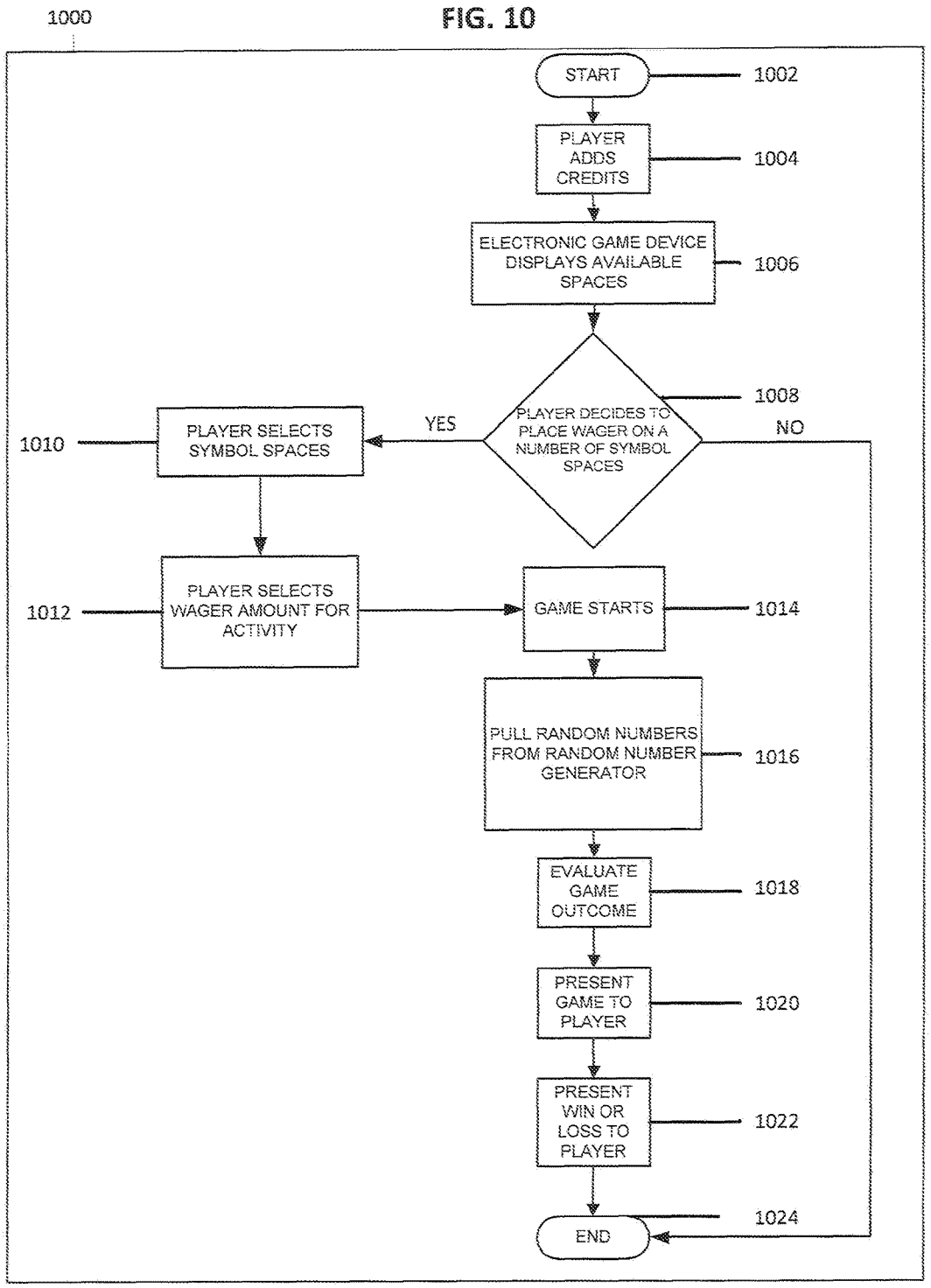
FIG. 10 is a flow diagram for allowing a player to select symbol spaces to create their own payline, according to one embodiment.

In FIG. 10, a player selection payline flow diagram 1000 is shown. The method may include the starting of the game (step 1002). The method may include the player adding credits to electronic gaming device 100 (step 1004). The method may further display available symbol space from which the player may select to create a custom payline (step 1006). The method may determine if player entered the appropriate wager for the appropriate number of symbol spaces needed (step 1008). If the appropriate wager was not entered then the method may move to the end (step 1024). If the appropriate wager was entered then the method may move to step 1010. The method may further allow the player to select the appropriate number of symbol spaces (step 1010). The method may further include the player selecting how large of a wager to place on the symbol spaces selected (step 1012). The method may then move to starting the game (step 1014). The method may include electronic gaming device 100 pulling random numbers from the random number generator (step 1016). The method may further include the evaluation of the game outcome for the payline as customized by the player (step 1018). The method may include presenting the game play to the player (step 1020). The method may include presenting the game outcome, as based on the payline customized by the player, by displaying win or loss to the player (step 1022). The method may then end (step 1024).

Figure 11:
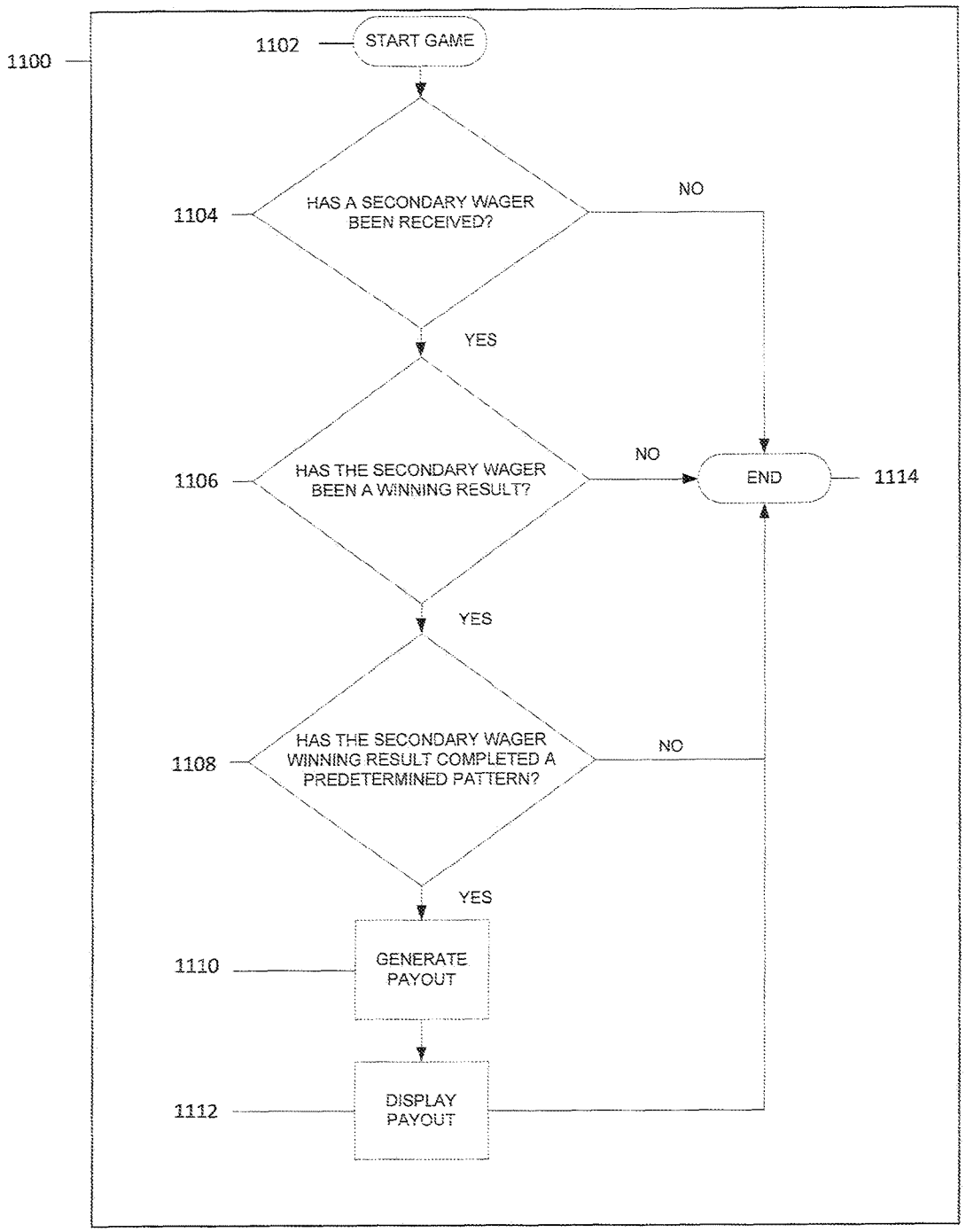
FIG. 11 is a flow diagram of an electronic gaming device, which may allow a player to make a secondary wager on selected game outcomes to achieve a predetermined pattern, according to one embodiment.

In FIG. 11, a payout for a secondary wager to complete a predetermined pattern flow diagram 1100 is shown. The method may include the starting of the game (step 1102). The method may further determine if a secondary wager has been received (step 1104). If the secondary wager was not received, then the method may move to the game ending (step 1114). If the secondary wager was received, the method may evaluate if the secondary wager has been a winning result (step 1106). If the secondary wager was not a winning result, then the method may move to the game ending (step 1114). If the secondary wager was a winning result, then the method may determine if the winning result completed a predetermined pattern (step 1108). If the secondary wager winning result did not complete a predetermined pattern, then the method may move to the game ending (step 1114). If the secondary wager winning result did complete a predetermined pattern, then the method may generate a payout (step 1110). The method may further display the payout to the player (step 1112). The method may then end the game (step 1114).

In an exemplary embodiment, an electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor. The processor may receive primary wagers on the first payline and the second payline. The processor may receive one or more secondary wagers on one or more selected paylines. The selected paylines may be based on data received from a player. The processor may determine a selected payline's payout based on the one or more selected paylines.

In another embodiment, the processor may determine a payout based on the primary wagers. The electronic gaming device may include a network interface, which may receive data from at least one of a server and one or more gaming devices. The electronic gaming device may include a display, which may display one or more selected paylines.

In another example, the display may shade one or more non-selected paylines. The electronic gaming device may include a player preference input device. The player preference input device may modify a game configuration based on data from an identification device. The processor may multiply a prize value based on a selected payline occurrence.

In another embodiment, a method of game play may include receiving one or more primary wagers on at least one of a first payline and a second payline. The method may include receiving a secondary wager on at least one selected payline. The selected payline may be based on selection data. The selection data may be based on player input. The at least one selected payline may be one of the first payline and the second payline. The method may include determining one or more primary wager payouts. Further, the method may include determining one or more secondary wager payouts.

In another example, the primary wager payout is based on the first payline and a secondary wager payout is based on the first payline. The method may include displaying paylines based on the primary wager. The method may include displaying the at least one selected paylines. The method may include highlighting the at least one selected paylines. The method may include displaying paylines based on the primary wager, displaying the at least one selected paylines, highlighting the at least one selected paylines, and/or shading each payline, which is not a selected payline.

In another example, the method may include obtaining a player preference data and modifying a game configuration based on the player preference data. The method may include receiving data from at least one of a server and one or more gaming devices. The method may include multiplying a prize value based on a selected payline occurrence.

In another embodiment, the electronic gaming system may include a server. The server may include a server memory and a server processor. The server may receive primary wagers on the first payline and the second payline. The server processor may receive one or more secondary wagers on one or more selected paylines. The selected paylines may be based on data received from a player. The server processor may determine a selected paylines payout based on the one or more selected paylines. The server memory may include a payline module. The payline module may include a plurality of payline structures.

In another example, the server processor may determine a payout based on the primary wagers. The server processor via a display may display one or more selected paylines. The display may shade one or more non-selected paylines.

In one embodiment, the electronic gaming device may include a plurality of reels. The plurality of reels may include a plurality of symbols. The electronic gaming device may include a first payline, a second payline, and a memory. The memory may include a payline module. The payline module may include a plurality of payline structures. The electronic gaming device may include a processor, which may receive primary wagers on the first payline and the second payline. The processor may receive one or more secondary wagers on one or more selected paylines. The selected paylines may be based on data received from a player. The one or more selected paylines may be one or more customized paylines generated via one or more symbol areas being selected by a player. The processor may determine one or more customized payline payouts based on the one or more customized paylines.

In another example, the processor may determine a payout based on the primary wagers. In one example, the electronic gaming device may include a network interface, which may receive data from at least one of a server and one or more gaming devices. In another example, the electronic gaming device may include a display, which may display one or more customized paylines. In another example, the display may shade one or more non-customized paylines. In another example, the electronic gaming device may include a player preference input device. The player preference input device may modify a game configuration based on data from an identification device. In one example, the processor may multiply a prize value based on a customized payline occurrence.

In another embodiment, the method of providing gaming options via an electronic gaming device may include receiving one or more primary wagers on at least one of a first payline and a second payline. The method may include receiving a secondary wager on one or more customized paylines generated via one or more symbol areas being selected by a player. The method may include determining one or more primary wager payouts. The method may include determining one or more secondary wager payouts. The method may include determining one or more customized payline payouts based on the one or more customized paylines.

In one example, the primary wager payout may be based on the first payline and one or more secondary wager payouts being based on the one or more customized paylines. In another example, the method may include displaying paylines based on the primary wager. In one example, the method may include displaying the one or more customized paylines. In an example, the method may include highlighting the at least one of the one or more customized paylines. In another example, the method may include displaying paylines based on the primary wager, displaying at least one or more customized paylines, highlighting at least one or more customized paylines, and/or shading each payline which is not a customized payline.

In one example, the method may include obtaining a player preference data and modifying a game configuration based on the player preference data. In another example, the method may include receiving data from at least one of a server and one or more gaming devices. In one example, the method may include multiplying a prize value based on a customized payline occurrence.

In another embodiment, the electronic gaming system may include a server, which may include a server memory and a server processor. The server may receive primary wagers on the first payline and the second payline. The server processor may receive one or more secondary wagers on one or more selected paylines. The one or more selected paylines may be one or more customized paylines generated via one or more symbol areas being selected by a player. The server processor may determine one or more customized payline payouts based on the one or more customized paylines. The server memory may include a payline module. The payline module may include a plurality of payline structures.

In one example, the server processor may determine a payout based on the primary wagers. In another example, the server processor via a display may display one or more customized paylines. In an example, the display via the processor may shade one or more non-customized paylines.

Gaming system may be a "state-based" system. A state-based system stores and maintains the system's current state in a non-volatile memory. Therefore, if a power failure or other malfunction occurs, the gaming system will return to the gaming system's state before the power failure or other malfunction occurred when the gaming system is powered up.

State-based gaming systems may have various functions (e.g., wagering, payline selections, reel selections, game play, bonus game play, evaluation of game play, game play result, steps of graphical representations, etc.) of the game. Each function may define a state. Further, the gaming system may store game histories, which may be utilized to reconstruct previous game plays.

A state-based system is different than a Personal Computer ("PC") because a PC is not a state-based machine. A state-based system has different software and hardware design requirements as compared to a PC system.

The gaming system may include random number generators, authentication procedures, authentication keys, and operating system kernels. These devices, modules, software, and/or procedures may allow a gaming authority to track, verify, supervise, and manage the gaming system's codes and data.

A gaming system may include state-based software architecture, state-based supporting hardware, watchdog timers, voltage monitoring systems, trust memory, gaming system designed communication interfaces, and security monitoring.

For regulatory purposes, the gaming system may be designed to prevent the gaming system's owner from misusing (e.g., cheating) via the gaming system. The gaming system may be designed to be static and monolithic.

In one example, the instructions coded in the gaming system are non-changeable (e.g., static) and are approved by a gaming authority and installation of the codes are supervised by the gaming authority. Any change in the system may require approval from the gaming authority. Further, a gaming system may have a procedure/device to validate the code and prevent the code from being utilized if the code is invalid. The hardware and software configurations are designed to comply with the gaming authorities' requirements.

As used herein, the term "mobile device" refers to a device that may from time to time have a position that changes. Such changes in position may comprise of changes to direction, distance, and/or orientation. In particular examples, a mobile device may comprise of a cellular telephone, wireless communication device, user equipment, laptop computer, other personal communication system ("PCS") device, personal digital assistant ("PDA"), personal audio device ("PAD"), portable navigational device, or other portable communication device. A mobile device may also comprise of a processor or computing platform adapted to perform functions controlled by machine-readable instructions.

The methodologies described herein may be implemented by various means depending upon applications according to particular examples. For example, such methodologies may be implemented in hardware, firmware, software, or combinations thereof. In a hardware implementation, for example, a processing unit may be implemented within one or more application specific integrated circuits ("ASICs"), digital signal processors ("DSPs"), digital signal processing devices ("DSPDs"), programmable logic devices ("PLDs"), field programmable gate arrays ("FPGAs"), processors, controllers, micro-controllers, microprocessors, electronic devices, other devices units designed to perform the functions described herein, or combinations thereof.

Some portions of the detailed description included herein are presented in terms of algorithms or symbolic representations of operations on binary digital signals stored within a memory of a specific apparatus or a special purpose computing device or platform. In the context of this particular specification, the term specific apparatus or the like includes a general purpose computer once it is programmed to perform particular operations pursuant to instructions from program software. Algorithmic descriptions or symbolic representations are examples of techniques used by those of ordinary skill in the arts to convey the substance of their work to others skilled in the art. An algorithm is considered to be a self-consistent sequence of operations or similar signal processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals, or the like. It should be understood, however, that all of these or similar terms are to be associated with appropriate physical quantities and are merely convenient labels. Unless specifically stated otherwise, as apparent from the discussion herein, it is appreciated that throughout this specification discussions utilizing terms such as "processing," "computing," "calculating," "determining" or the like refer to actions or processes of a specific apparatus, such as a special purpose computer or a similar special purpose electronic computing device. In the context of this specification, therefore, a special purpose computer or a similar special purpose electronic computing device is capable of manipulating or transforming signals, typically represented as physical electronic or magnetic quantities within memories, registers, or other information storage devices, transmission devices, or display devices of the special purpose computer or similar special purpose electronic computing device.

Reference throughout this specification to "one example," "an example," "embodiment," and/or "another example" should be considered to mean that the particular features, structures, or characteristics may be combined in one or more examples.

While there has been illustrated and described what are presently considered to be example features, it will be understood by those skilled in the art that various other modifications may be made, and equivalents may be substituted, without departing from the disclosed subject matter. Additionally, many modifications may be made to adapt a particular situation to the teachings of the disclosed subject matter without departing from the central concept described herein. Therefore, it is intended that the disclosed subject matter not be limited to the particular examples disclosed.

The invention claimed is:

1. An electronic gaming device comprising:

a credit device configured to accept an item associated with a monetary value;

at least one display device;

a plurality of display areas, the plurality of display areas configured to display a plurality of symbols;

at least one first payline;

a memory, the memory including a payline module, the payline module including a plurality of payline structures;

a user input device configured to enable a player to select a wager amount and initiate a game play where the wager amount is subtracted from a credit balance, the credit balance being funded at least in part via the credit device, where the wager amount includes at least one of one or more primary wagers and one or more optional secondary wagers; and a processor configured to:

receive the one or more primary wagers on the at least one first payline, receive the one or more optional secondary wagers on one or more player defined paylines, the one or more player defined paylines being based on data received from the player, the one or more player defined paylines being one or more customized paylines generated via a plurality of symbol areas being selected by the player and a player defined winning symbol being selected by the player for the one or more player defined paylines, determine one or more customized payline payouts based on one or more combinations of said player defined winning symbol being received relative to the one or more player defined paylines, cause said at least one display device to display symbols in said plurality of display areas, and increase the credit balance based on any determined award amounts.

2. The electronic gaming device of claim 1, wherein the processor is further configured to determine a payout based on the one or more primary wagers.

3. The electronic gaming device of claim 1, further comprising a network interface configured to receive data from at least one of a server and one or more gaming devices.

4. The electronic gaming device of claim 1, wherein said player defined winning symbol is defined by an image provided by said player to said electronic gaming device.

5. The electronic gaming device of claim 4, wherein the image is provided from an electronic communication device of the player.

6. The electronic gaming device of claim 1, further comprising a player preference input device, the player preference input device configured to modify a game configuration based on data from an identification device.

7. The electronic gaming device of claim 1, wherein the processor is configured to multiply a prize value based on a customized payline occurrence.

8. A method of providing gaming options via an electronic gaming device comprising:

receiving via a credit device an item associated with a monetary value;

establishing via one or more processors a credit balance based at least in part on the received item;

receiving via a wager button a wager amount on a play of a game, wherein the wager amount is deducted from the credit balance, where the wager amount includes at least one of one or more primary wagers and an optional secondary wager;

receiving the one or more primary wagers on at least one first payline;

receiving the optional secondary wager on one or more player defined paylines generated via a plurality of symbol areas being selected by a player and a player defined winning symbol being selected by the player for the one or more player defined paylines;

determining one or more primary wager payouts;

determining one or more customized payline payouts based on one or more combinations of said player defined winning symbol being received relative to the one or more player defined paylines; and displaying symbols in said plurality of symbol areas via a display device of said electronic gaming device;

wherein the credit balance is increased by any determined award amounts.

9. The method of claim 8, wherein a first primary wager payout is based on the at least one first payline and one or more secondary wager payouts is based on the one or more player defined paylines.

10. The method of claim 8, further comprising receiving an image from said player to comprise said player defined winning symbol.

11. The method of claim 10, wherein said image is uploaded from a player's communication device.

12. The method of claim 8, further comprising highlighting said one or more player defined paylines.

13. The method of claim 8, further comprising:

displaying said one or more first paylines based on the one or more primary wager;

displaying said one or more player defined paylines;

highlighting at least one or more of said player defined paylines; and shading each payline which is not a player defined payline.

14. The method of claim 8, further comprising obtaining a player preference data and modifying a game configuration based on the player preference data.

15. The method of claim 8, further comprising receiving data from at least one of a server and one or more gaming devices.

16. The method of claim 8, further comprising multiplying a prize value based on a player defined payline win.

17. An electronic gaming system comprising:

a credit device configured to accept an item associated with a monetary value;

a user input device configured to enable a player to select a wager amount and initiate a game play, wherein the wager amount is subtracted from a credit balance funded at least in part via the credit device where the wager amount includes at least one of one or more primary wagers and one or more optional secondary wagers;

a server including a server memory and a server processor, the server configured to receive the one or more primary wagers on at least one first payline, receive the one or more optional secondary wagers on one or more player defined paylines, the one or more player defined paylines being one or more customized paylines generated via a plurality of symbol areas being selected by the player and a player defined winning symbol being selected by the player for the one or more player defined paylines, and determine one or more customized payline payouts based on one or more combinations of said player defined winning symbol being received relative to the one or more player defined paylines; and the server memory including a payline module, the payline module including a plurality of pay line structures;

wherein the credit balance is increased by any determined award amounts.

18. The electronic gaming system of claim 17, wherein the server processor is further configured to determine a payout based on the one or more primary wagers.

19. The electronic gaming system of claim 17, wherein the server processor via a display is configured to display the one or more customized paylines.

20. The electronic gaming system of claim 19, wherein said player defined winning symbol is defined by an image provided by said player to said electronic gaming system.

* * * * *